US007106262B2

(12) United States Patent
Baranski

(10) Patent No.: US 7,106,262 B2
(45) Date of Patent: Sep. 12, 2006

(54) DOUBLE ON-GLASS SLOT ANTENNA

(75) Inventor: Detlef Baranski, Recklinghausen (DE)

(73) Assignee: Pilkington Automotive Deutschland GmbH, Witten (DE)

( * ) Notice: Subject to any disclaimer, the term of this patent is extended or adjusted under 35 U.S.C. 154(b) by 0 days.

(21) Appl. No.: 10/490,031

(22) PCT Filed: Sep. 17, 2002

(86) PCT No.: PCT/EP02/10399

§ 371 (c)(1),
(2), (4) Date: Sep. 29, 2004

(87) PCT Pub. No.: WO03/028151

PCT Pub. Date: Apr. 3, 2003

(65) Prior Publication Data

US 2005/0035913 A1 Feb. 17, 2005

(30) Foreign Application Priority Data

Sep. 20, 2001 (DE) ..... 101 46 439

(51) Int. Cl.
*H01Q 1/32* (2006.01)

(52) U.S. Cl. ..... 343/713; 343/770

(58) Field of Classification Search ..... 343/713, 343/767, 770

See application file for complete search history.

(56) References Cited

U.S. PATENT DOCUMENTS 4,768,037 A 8/1988 Inaba et al.
5,012,255 A 4/1991 Becker
5,124,714 A * 6/1992 Harada ..... 343/713
5,177,494 A 1/1993 Dorrie et al.
5,355,144 A * 10/1994 Walton et al. ..... 343/713
5,406,295 A 4/1995 Baranski et al.

(Continued)

FOREIGN PATENT DOCUMENTS

DE 37 43 099 A1 7/1988

(Continued)

OTHER PUBLICATIONS

H. Wieners et al., "Schlitzscheibenantenne Fuer DVB-T", Funkschau, Franzis-Verlag K.G. Muchen, DE, vol. 72, No. 4, Feb. 5, 1999, pp. 70-71.

*Primary Examiner*—Tan Ho
(74) *Attorney, Agent, or Firm*—Buchanan Ingersoll & Rooney PC

(57) ABSTRACT

A motor vehicle antenna pane with improved diversity and/or multiband applicability in the VHF range for mounting in a metal surround (1) provided with a conductive panel (2) spaced from the metal surround (1) such that an elongated dielectric slot (3) is produced between the two. In the slot (3) are arranged a number of slot antennas incorporating elongated radiating areas (4,5) extending along the length of the slot (3) the geometric forms of which are bounded by an HF-conductive frame incorporating at least one ground edge conductor (1,6, 7) and one signal edge conductor (2, 8, 9) and at least one terminating conductor (10, 11) terminating the slot antennas at their longitudinal ends. Each of the radiating areas (4,5) incorporates a terminal area (12, 13) in which at neighbouring terminal points (14, 15, 16, 17) the ground conductor (19 of an unbalanced connecting lead (18,21) assigned to the respective slot antenna may be connected to the ground edge conductor (1,6,7) and its signal conductor (20) may connected to the signal edge conductor (2, 8, 9) of the respective slot antenna.

21 Claims, 13 Drawing Sheets

U.S. PATENT DOCUMENTS

Figure 1:
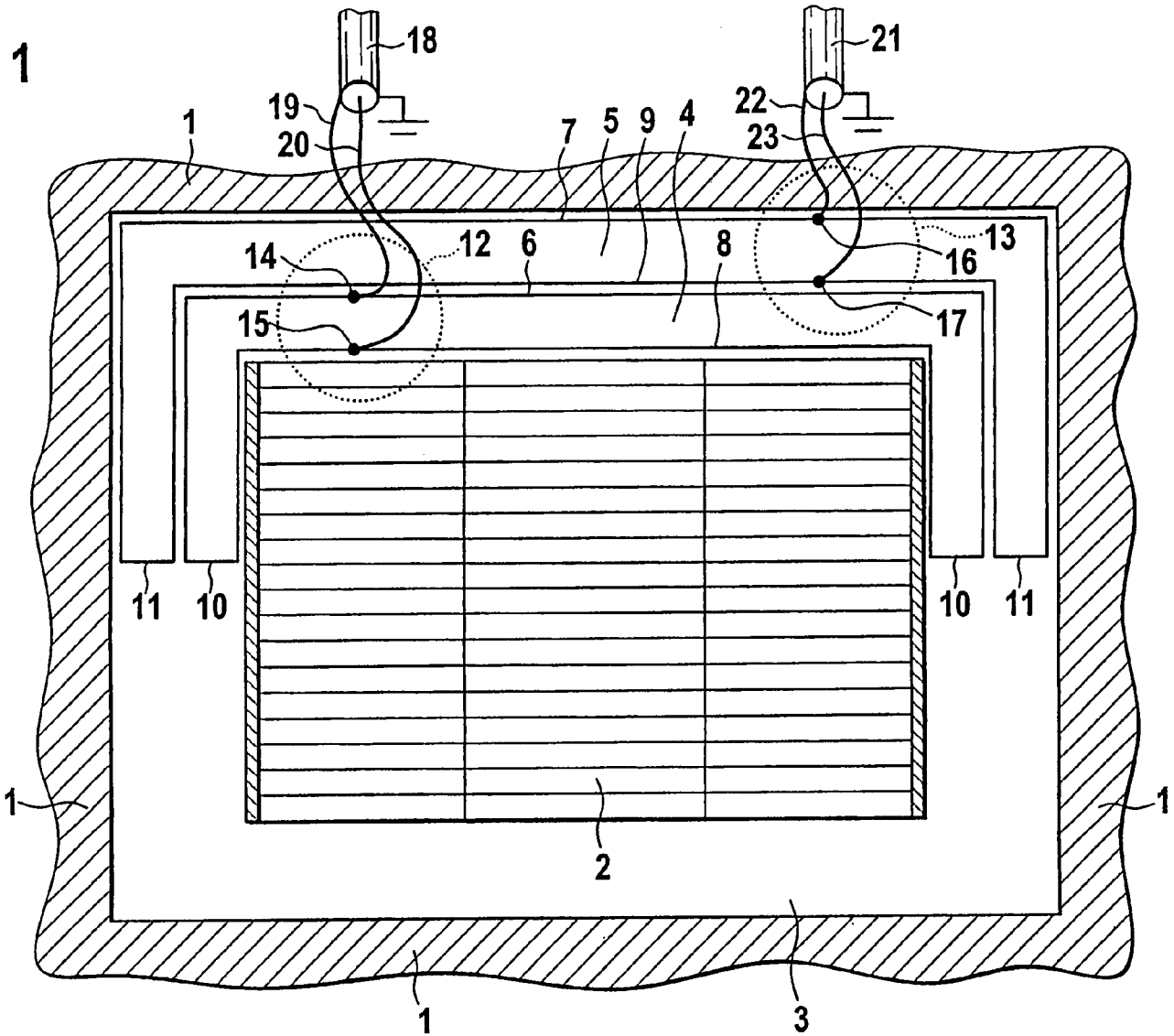

| | | | | |
|---|---|---|---|---|
| 5,451,966 | A | 9/1995 | Du et al. | |
| 5,610,618 | A * | 3/1997 | Adrian et al. | 343/713 |
| 5,646,637 | A | 7/1997 | Miller | |
| 5,714,965 | A * | 2/1998 | Taguchi | 343/866 |
| 5,739,794 | A * | 4/1998 | Nagy et al. | 343/713 |
| 5,831,580 | A | 11/1998 | Taniguchi et al. | |
| 5,898,407 | A | 4/1999 | Paulus et al. | |
| 6,201,504 | B1 | 3/2001 | Aminzadeh et al. | |
| 6,236,372 | B1 | 5/2001 | Lindenmeier et al. | |
| 6,266,023 | B1 * | 7/2001 | Nagy et al. | 343/713 |
| 6,329,950 | B1 * | 12/2001 | Harrell et al. | 343/700 MS |
| 6,400,334 | B1 | 6/2002 | Lindenmeier et al. | |
| 6,646,618 | B1 * | 11/2003 | Sievenpiper | 343/770 |
| 6,653,983 | B1 * | 11/2003 | Masuda et al. | 343/767 |
| 6,661,386 | B1 * | 12/2003 | Petros et al. | 343/713 |
| 6,828,941 | B1 * | 12/2004 | King et al. | 343/767 |
| 6,937,198 | B1 * | 8/2005 | Iijima et al. | 343/713 |

FOREIGN PATENT DOCUMENTS

| | | | |
|---|---|---|---|
| DE | 37 14979 | A1 | 11/1988 |
| DE | 44 47 134 | | 7/1995 |
| DE | 44 47 134 | A1 | 7/1995 |
| DE | 195 08 042 | A1 | 10/1995 |
| EP | 0 332 898 | A1 | 2/1989 |
| EP | 0 561 272 | A1 | 3/1993 |
| EP | 0 332 898 | B1 | 6/1993 |
| EP | 0717 459 | A1 | 6/1996 |
| EP | 0 531 734 | B1 | 11/1996 |
| EP | 0 760 537 | | 3/1997 |
| EP | 0760 537 | A2 | 3/1997 |
| EP | 0 557 794 | B1 | 6/1997 |
| EP | 0 897 198 | A2 | 2/1999 |
| EP | 0899 811 | A2 | 3/1999 |
| EP | 0643 437 | B1 | 10/1999 |
| EP | 0760 537 | B1 | 5/2000 |
| EP | 1 076 375 | A2 | 2/2001 |
| EP | 0 866 514 | B1 | 5/2001 |
| EP | 0 856 905 | B1 | 12/2002 |
| JP | 59-196606 | | 8/1984 |
| JP | 03 204202 | | 9/1991 |
| JP | 06-045817 | | 2/1994 |
| WO | WO96/31918 | | 10/1996 |
| WO | WO99/66587 | | 12/1999 |

* cited by examiner

DOUBLE ON-GLASS SLOT ANTENNA

The invention concerns a vehicle antenna pane according to the preamble of claim 1.

A vehicle antenna pane of this type is known from EP 0 760 537 A2. In the case of the known vehicle antenna pane consisting of single pane or laminated glass the metal surround is formed by the vehicle bodywork. At the centre of the pane a conductive panel formed by a transparent solar control coating is arranged. The conductive panel encloses with the vehicle bodywork an elongated, particularly a rectangular (trapezoidal) or inverted-U-shaped dielectric slot. The metal vehicle bodywork and, if required, additional near-border virtual ground conductors, on the one hand, and the conductive panel, on the other, form the essential components of the HF-conductive frames of one or more slot antennas for the VHF range (30–300 MHz), the normal frequency range for radio (FM) and television reception. The HF-conductive frame in each case encloses the dielectric radiating area of each slot antenna. In the case of the slot antennas of the known vehicle antenna pane terminating conductors terminate the radiating areas of these antennas at their longitudinal ends and thereby define the effective length of the slot antennas. The terminating conductors are formed either by the metal vehicle bodywork itself or by separate conductors extending across the dielectric slot, e.g. by heating panel or antenna connecting leads. Each slot antenna has a terminal area, in which the ground conductor and the signal conductor of an unbalanced connecting lead, in particular a coaxial cable, are connected to the two opposed edge conductors of the slot antennas at terminal points neighboured to one another across the longitudinal extension of the radiating areas. The coaxial cables are in each case connected HF-conductively to the vehicle bodywork or the near-border virtual ground conductors by their ground conductor and to the conductive panel by their signal conductor in such a way that in the case of all slot antennas of the known vehicle antenna pane their ground conductors are formed by the metal vehicle bodywork or the near-border virtual ground conductors and their signal conductor by the conductive panel. The connecting leads connect the slot antennas to a transmitting or receiving device, in particular, a radio or TV receiver, located in a suitable part of the vehicle.

The known vehicle antenna pane has proved itself effective for the wide-band and diversity reception of electromagnetic waves over a large frequency range. A disadvantage is, however, that the slot antennas may interfere with each other when under load. The arrangement of several connecting conductors across the slot results in an effective shortening (termination) of one slot antenna by the connecting conductor of the other and undesirably reduces the available receiving power and maximum length of the individual slot antennas.

Another vehicle antenna pane with one or two slot antenna(s) for TV reception is known from JP-A 59-196 606. Here, too, the metal surround is formed by the vehicle bodywork, while the conductive panel spaced from the metal surround is formed by at least one U-shaped metal plate, and, if necessary, a heating panel is also provided in the centre of the pane. The U-shaped metal plate has at the end of each leg of the U a portion bent towards the vehicle bodywork and is arranged in such a way that together with the vehicle bodywork it forms the HF-conductive frame of a slot antenna whose radiating area takes the form of a U lying on its side. If two slot antennas are provided, these are arranged at a distance from each other on the left- and right-hand side of the vehicle antenna pane. The possible applications of the known antenna arrangement are limited. Normally there is insufficient room to accommodate the required antenna structures on vehicle panes.

Vehicle antenna panes with one or more slot antenna(s) for various frequency ranges can be found in a large number of other publications, e.g. DE 37 14 979 A1, U.S. Pat. No. 5,831,580, U.S. Pat. No. 5 739 794, U.S. Pat. No. 5,610,618, WO 99-66587 A1, EP 1 076 375 A2, EP 0 899 811 A2, EP 0 897 198 A2, EP 0 332 898 A1. In the theoretically ideal case slot antennas are formed from narrow dielectric slots in an infinitely extended conductive panel. In each case they are connected across the slot on both sides at opposite points at their edges, mostly in the middle of the slot. Since slot antennas represent asymmetrical antennas, they are connected by means of unbalanced connecting leads, in particular by means of a coaxial cable.

Besides the above mentioned publications, which relate partly to diversity applications, there is likewise a large number of publications on diversity antennas in general. EP 0 866 514 B1 should be mentioned only as an example and to explain the technical principles of diversity antennas in the VHF range.

To function well slot antennas require as extensive a conductive panel as possible around the dielectric slot-like radiating area used as an antenna. Their optimum geometric length is around half the mean wavelength of the relevant frequency range, multiplied by the dielectric shortening factor of the dielectric medium present in the dielectric slot. In the case of glass panes—where the shortening factor, depending upon pane thickness, is approx. 0.6–0.7—slot antennas for the VHF range (30–300 MHz) need slot lengths of typically between approx. 30 cm and 3 m. This slot length can generally be achieved in the case of normal vehicle panes with their widths of typically 1–1.5 m and heights of typically approx. 0.50–1 m.

A double slot antenna structure for mobile phone reception consisting of two rectangular conductor structures of differing width and identical length arranged one beside the other is mentioned in EP 0 643 437 B1. The double slot antenna designed for reception in the range of approx. 860 MHz has only a single connecting lead, whose ground conductor is connected to the lower edge conductor of the lower conductor rectangle and whose signal conductor is connected to the remaining horizontal edge conductors. An arrangement of this kind is not suitable for diversity or multiple reception in the VHF range.

The object of the invention is to specify a vehicle antenna pane of the type mentioned at the beginning which allows better use to be made of the limited space between the conductive panel and the border of the pane (the metal surround) for diversity and/or multi-range reception in the VHF range (30–300 MHz) with the aid of slot antennas. The invention is moreover intended to enable further antenna systems for higher frequency ranges up to the gigahertz range, but also of AM antennas or other two-dimensionally extended metallic structures to be accommodated without substantially impairing the function of the slot antennas. The slot antennas should have the potential to be largely decoupled from one another and thus be well suited to diversity applications in particular.

According to the invention at least two of the slot antennas are arranged parallel and adjacent to one another over at least a part of their length. Preferably their radiating areas do not overlap in the projection on the plane of the pane.

Surprisingly, according to the invention several slot antennas of great length and largely decoupled from one another can be located parallel and adjacent to one another in a narrow slot on a vehicle antenna pane having normal dimensions in the meter range, the slot being located between a conductive panel arranged in the centre of the pane and the vehicle bodywork or another metal surround. The arrangement according to the invention relies on the principle that for each of the slot antennas a separate HF circuit with its own terminal area is provided where in the case of all slot antennas being arranged in one plane all HF circuits are arranged beside one another and do not overlap. It is within the scope of the invention to arrange at least one of the slot antennas in another plane as one other slot antenna. In this case it is also possible to configure the slot antennas with their HF circuits so that their radiating areas are arranged above one another, such that they partially or even totally overlap in the projection on the plane of the pane.

Preferably the terminal areas of the slot antennas are set at a distance from each other along the length of the slot. The greater this distance is, the more the respective reception signals differ from one another over time when the vehicle is moving and the better the diversity suitability of the antennas. A large distance between the terminal areas of the two slot antennas is to be preferred particularly if the geometric forms of the radiating areas of the slot antennas and their position on the vehicle antenna pane differ from one another only slightly.

Likewise it is preferable if the radiating areas of the slot antennas possess different geometric forms. In this context geometric forms are described as differing from one another if they are not similar in a geometric sense. This is the case, for example, if one is L-shaped and the other U-shaped or one L-shaped with the point of intersection of the legs in the upper left-hand corner of the pane and the other L-shaped with the point of intersection of the legs in the upper right-hand corner of the pane. Here the different reception qualities aimed at are the result of the difference in the geometry of the radiating areas of the slot antennas. In this case it can be advantageous if the terminal areas of the slot antennas are located adjacent to one another in order to limit the connection effort.

For multi-range reception a design is especially suitable where the radiating areas of the slot antennas have different lengths.

Within the scope of the invention the HF-conductive frame of at least one of the slot antennas may comprise at least one permanent or switchable capacitive, inductive or resistive break element. This means that its otherwise continuous conductor structure is broken at at least one place on the frame and the contiguous conductor ends are connected to one another HF-conductively by a capacitance, an inductance or an ohmic resistance. This enables impedance matching and allows conductor structures in the neighbourhood of electrical arrangements like, for example, heater grids or heatable coatings, to be constructed more freely to enable undesired DC currents to be avoided. It is within the scope of the invention to make the break switchable, for example by the use of an electronic or electro-mechanic relais. It is thereby possible to modify the antenna characteristics or in case a heater panel is provided to separate galvanically the edge conductors of a slot antenna from the neighboured heater panel.

On one especially easily manufactured embodiment of the invention at least one of the edge conductors of the slot antennas is formed by the metal surround or by the conductive panel such that a separate edge conductor near the metal surround and/or near the conductive panel can be dispensed with.

It is, however, usually more advantageous for the antenna function if at least one of the edge conductors of the slot antennas is arranged on/in the vehicle antenna pane as a separate ground edge conductor or signal edge conductor set parallel and adjacent to the metal surround or the conductive panel. If provision is made for a separate ground edge conductor at the border of the pane near the metal surround, the slot antennas are functionally more independent of tolerances when fitting the vehicle antenna pane in the bodywork. Separate conductors are conductors that can be fitted, e.g. printed on and baked on or otherwise coated on a glass surface, onto/into the vehicle antenna pane in addition to the metal surround or the conductive panel and normally galvanically separated from these. Here within the scope of the invention it can be provided for the separate ground edge conductor to have a galvanic connection to the metal surround in order to produce a good ground connection. The provision for a separate signal edge conductor adjacent to the conductive panel is particularly practical in the case of conductive panels with a low conductivity or to avoid a galvanic contact, if the conductive panel is formed by a heater grid or other electrically fed arrangement.

In a preferred embodiment the HF-conductive frames of at least one of the slot antennas, but preferably all the slot antennas, are made up entirely of separate conductor structures fitted on/in the vehicle antenna pane in a "slot-in-slot" arrangement. In this case the HF circuits (HF-conductive frames) of the individual slot antennas are particularly well separated from each other to provide good diversity properties.

In the area in which they run parallel and adjacent the slot antennas are regularly placed very close together such that the adjacent edge conductors are coupled together HF-conductively. According to one special embodiment of the invention the radiating areas of two slot antennas are arranged adjacent to each other such that both slot antennas at least partly share a common edge conductor. This enables particularly good use to be made of the space available for the slot antennas.

The vehicle antenna pane according to the invention can be transformed to a wide-band antenna pane in particular by arranging an additional monopole or dipole antenna in the terminal area of one of the slot antennas and preferably inside its radiating area. An antenna of this type, which preferably has a linear structure and for which no separate connecting lead needs be provided for, is suitable for reception in frequency ranges above the VHF band, particularly in the gigahertz range.

It has been found particularly effective if the additional antenna for a higher frequency range incorporates at least one monopole with at least one assigned virtual ground conductor where the virtual ground conductor is connected HF-conductively to the ground edge conductor of the associated slot antenna and the monopole to its signal edge conductor.

Alternatively or additionally it is possible to integrate additional antennas for higher frequencies into the connecting device, notably into flat connecting cables or other types of connectors.

The antenna signals can be processed and amplified at different locations. One special embodiment of the invention is characterised by the fact that an impedance transformer and/or antenna amplifier is arranged in the terminal area of at least one of the slot antennas. An arrangement of this kind can function as a break element between the antenna and the feed line and because of its proximity to the antenna is suitable for improving the signal. Care should be taken only to ensure that the impedance transformer and/or antenna amplifier is sufficiently slim for it not to effectively shorten the slot antennas.

Provision can further be made for at least one two-dimensionally (generally even three-dimensionally) extended metallic structure to be fitted inside the slot and in particular inside the radiating area of a slot antenna and at a sufficient distance from its signal edge conductor. This can be, for example, a mirror base, a sensor, a tuner, a signal lamp, a screening structure for an external mobile phone antenna, a GPS antenna or the like. The distance between the metal structure and the signal edge conductor of the slot antenna(s) must be set so as to retain a minimum slot width to prevent the length of the slot antenna being undesirably effectively shortened by the metal structure arranged in it.

According to one particular embodiment of the invention at least one of the connecting leads has an extension in the form of an HF conductor, in particular a pseudo-coaxial cable, arranged on/in the vehicle antenna pane. Particularly suitable as a pseudo-coaxial structure is a coplanar structure with a ground conductor and a signal conductor in one plane or a triplanar structure with a signal conductor accompanied by ground conductors on both sides. This enables the external connecting leads to be bunched at one point of the vehicle antenna pane while still advantageously keeping the terminal areas of the individual slot antennas apart for diversity applications. Here as a rule it will be provided for that the ground conductor of the HF conductor is at least partially identical with the ground edge conductor of one of the slot antennas. For this purpose the ground edge conductor is preferably constructed wider, and the signal conductor of the HF conductor is run parallel and adjacent to the widened ground conductor of the HF conductor up to the effective terminal area of the slot antenna concerned.

The vehicle antenna pane according to the invention can, of course, form part of a diversity antenna arrangement incorporating further VHF antennas where the further VHF antennas can be fitted onto/into other vehicle panes or at other places in the vehicle.

A further advantage of the invention besides the possibility of use for diversity applications is that, if necessary, one and the same vehicle antenna pane can be used for countries in which different frequency ranges or polarisations apply for radio or TV reception, e.g. in Japan, on the one hand, and in the USA, on the other. All that is required is to provide slot antennas of various lengths, one of which is used in one country and the other in the other country, to be fitted parallel to each other in the vehicle antenna pane.

The preceding explanations all apply to receiving antennas. It goes without saying that the invention can also be applied to transmitting antennas.

Figure 2:
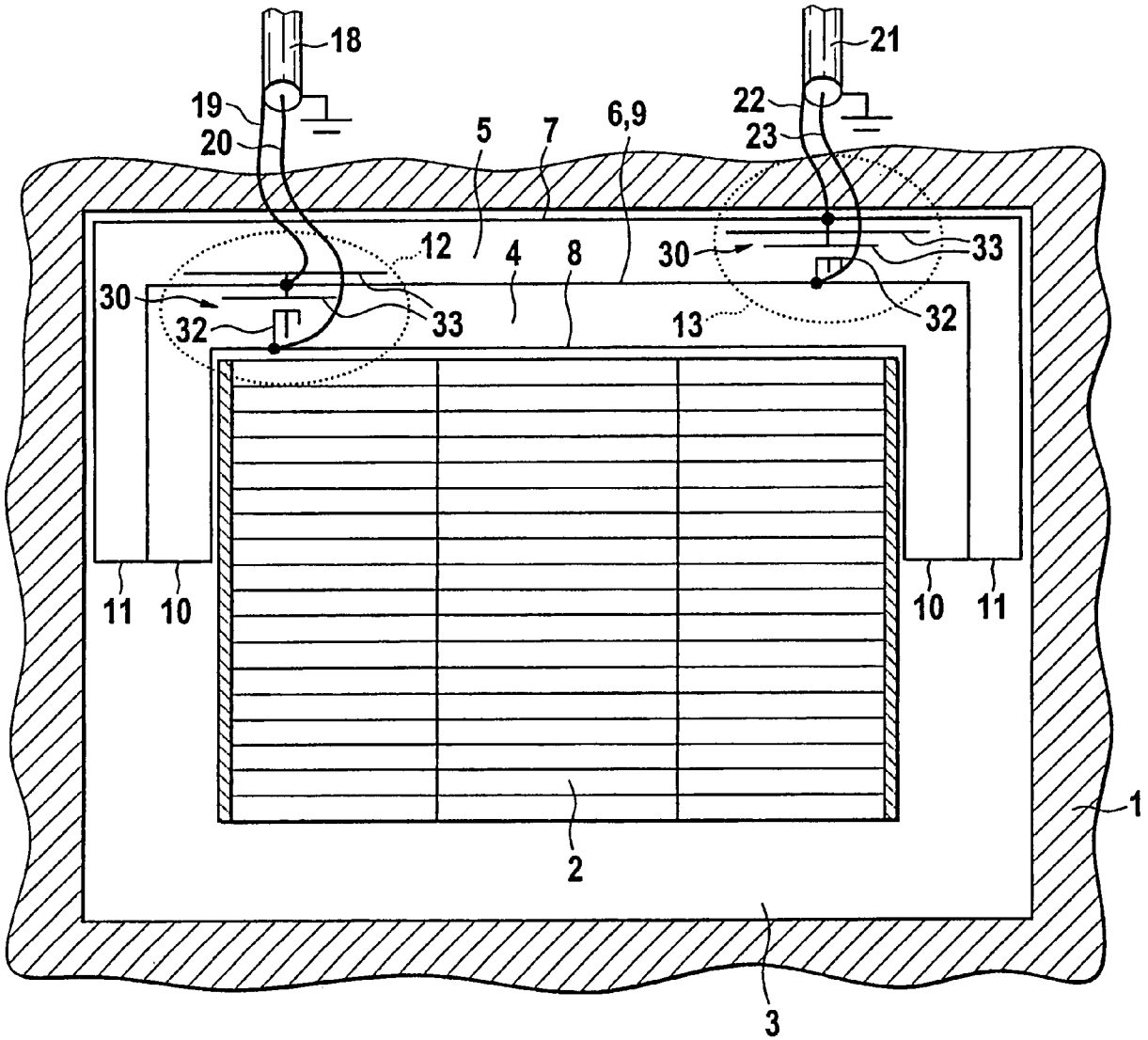
Figure 3:
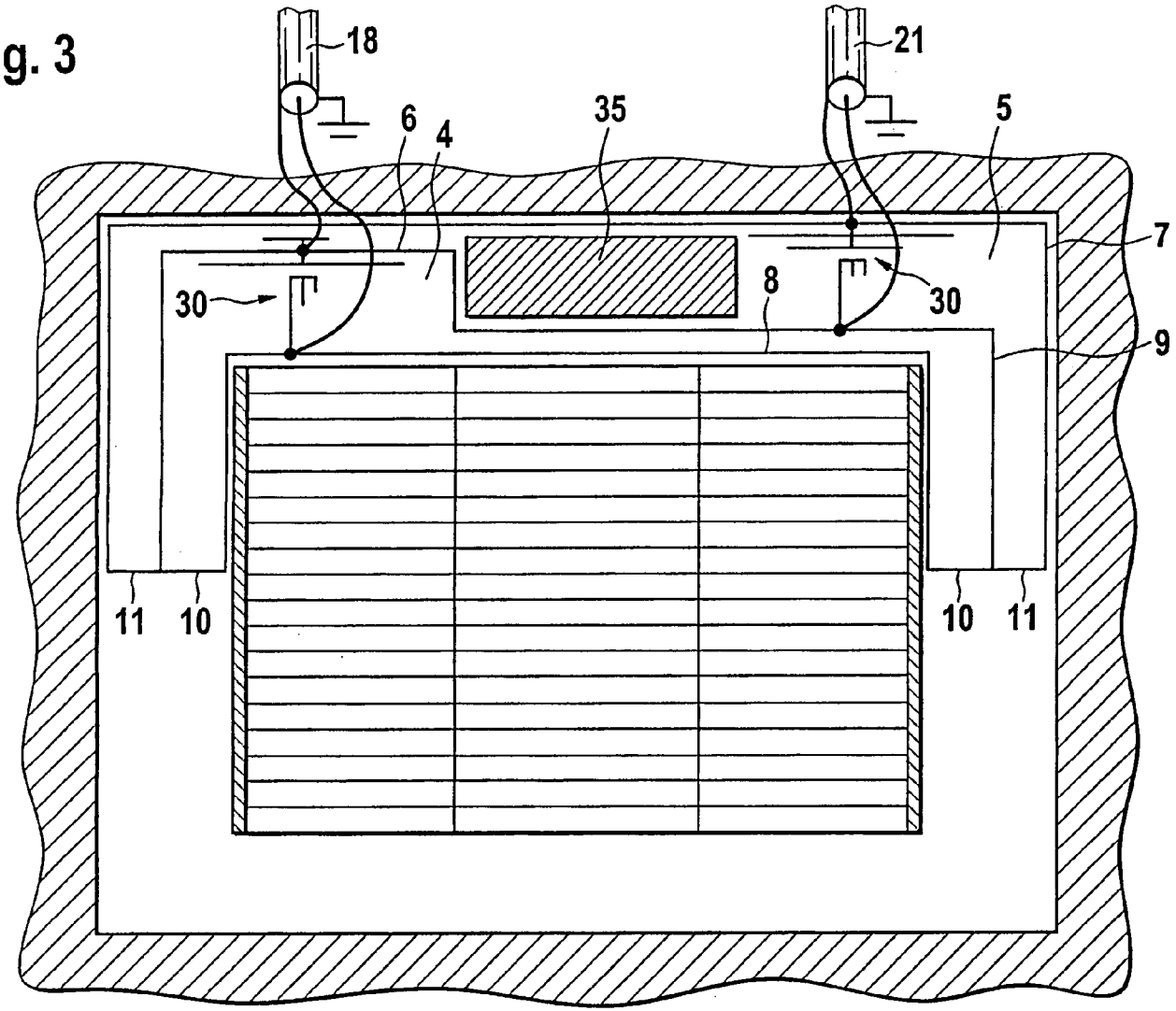
Figure 4:
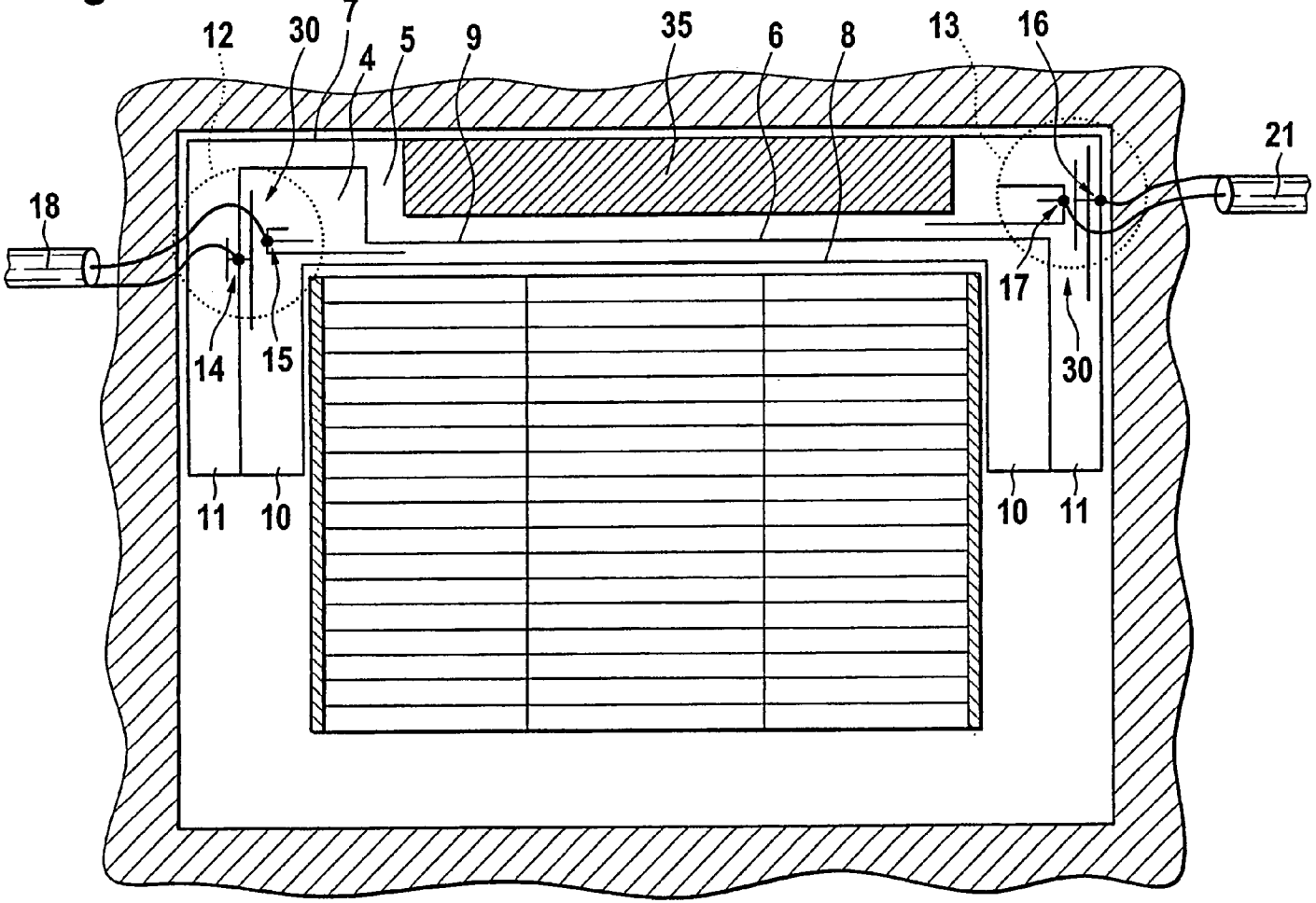
Figure 5:
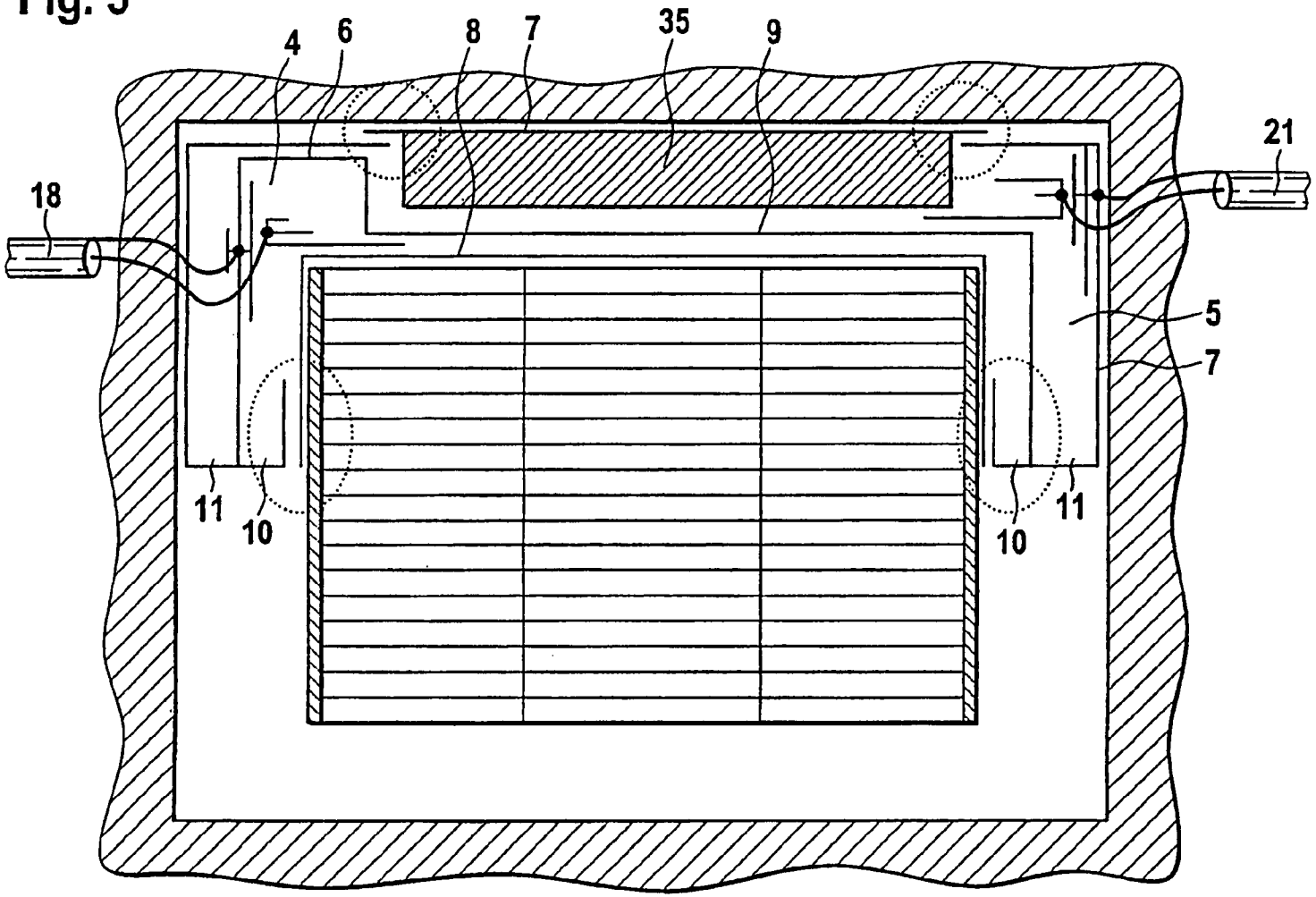
Figure 6:
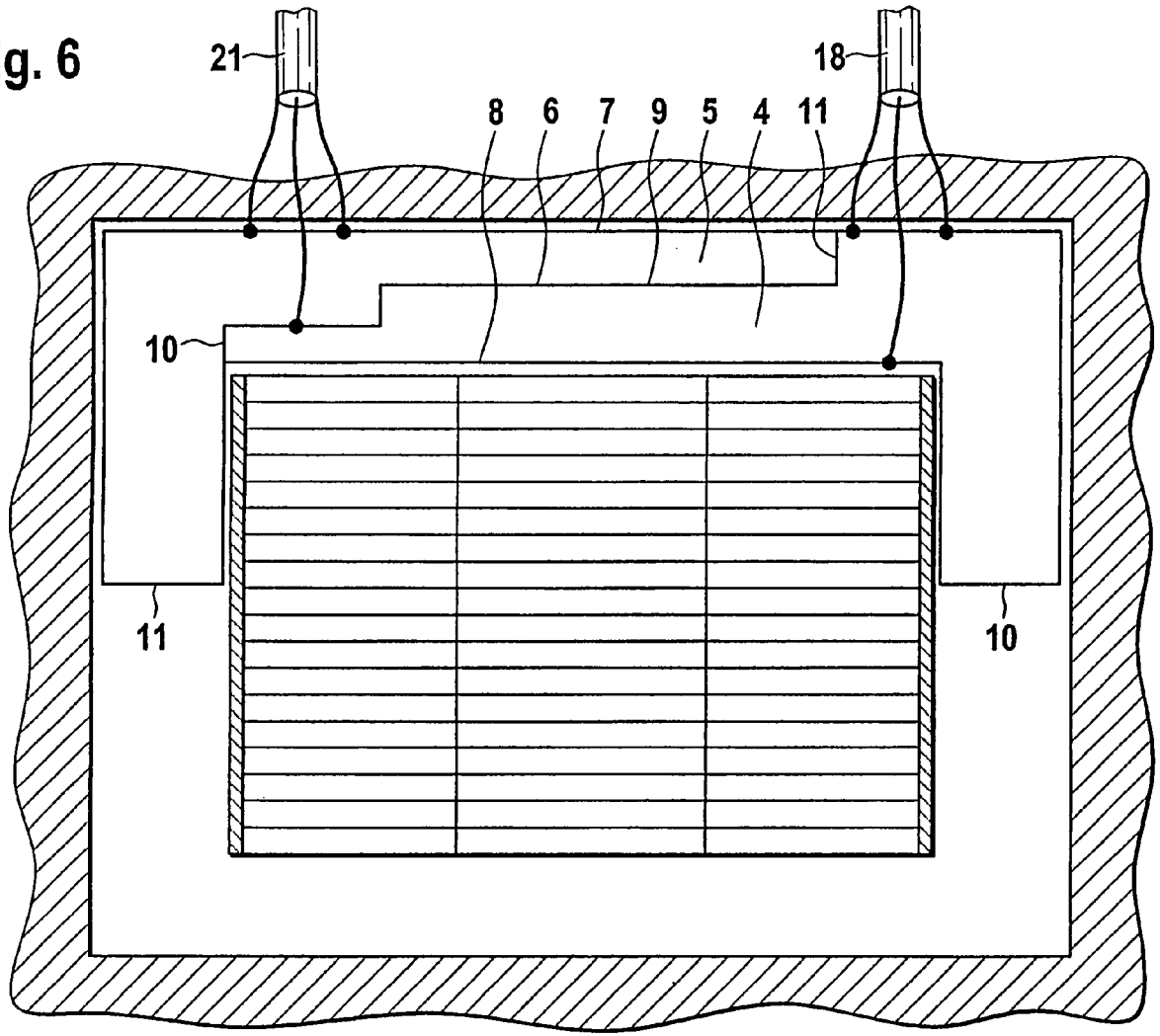
Figure 7:
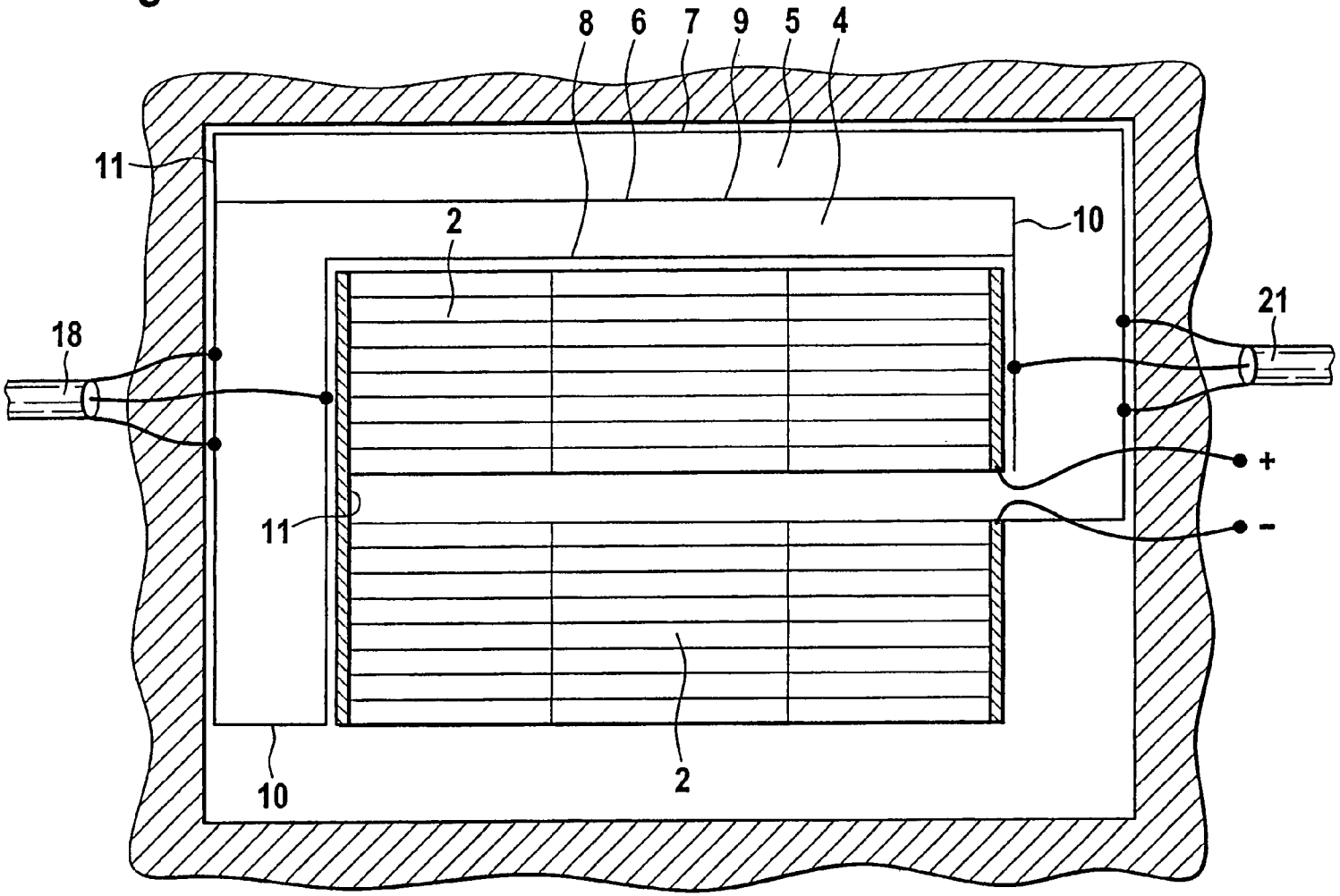
Figure 8:
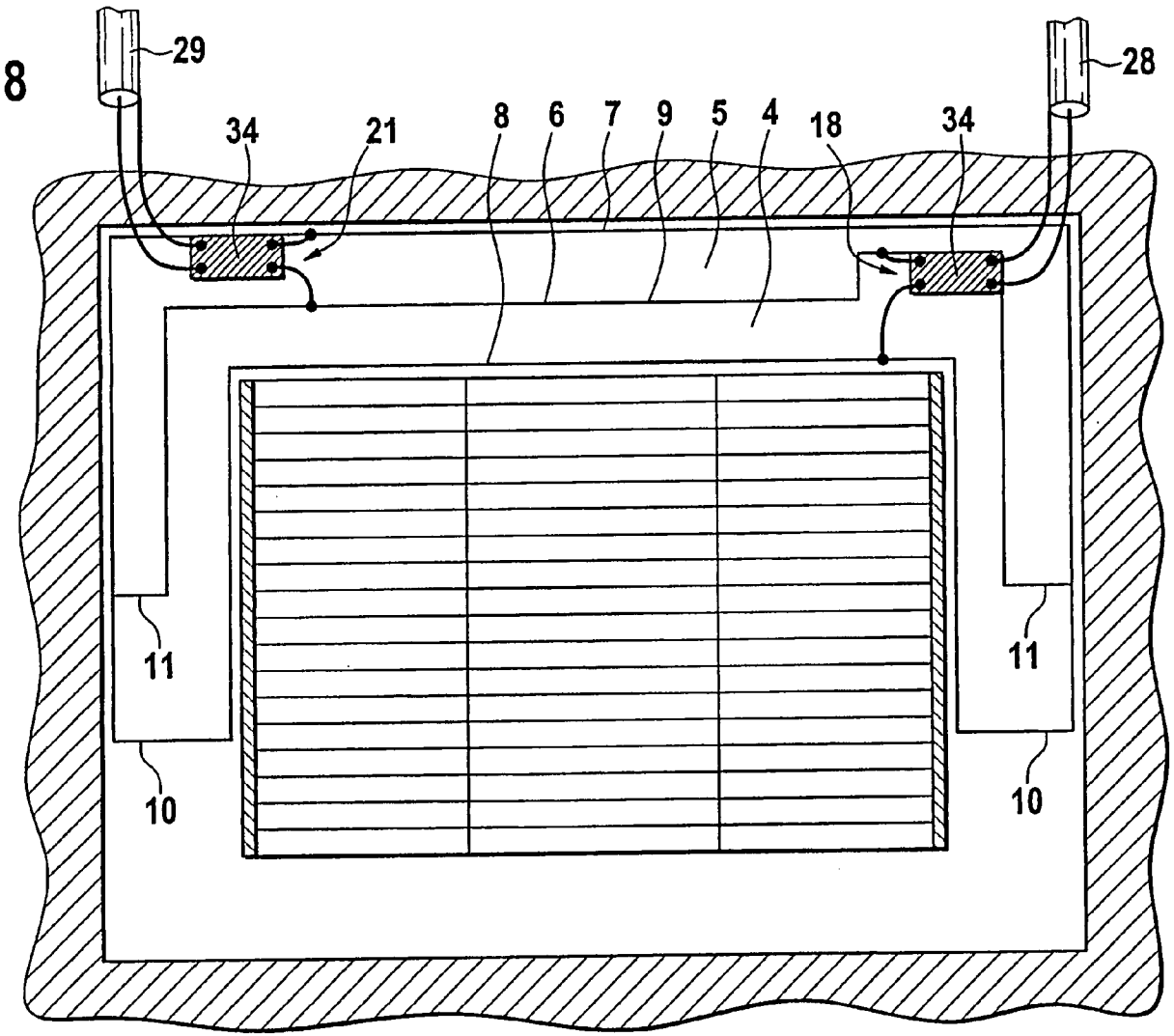
Figure 9:
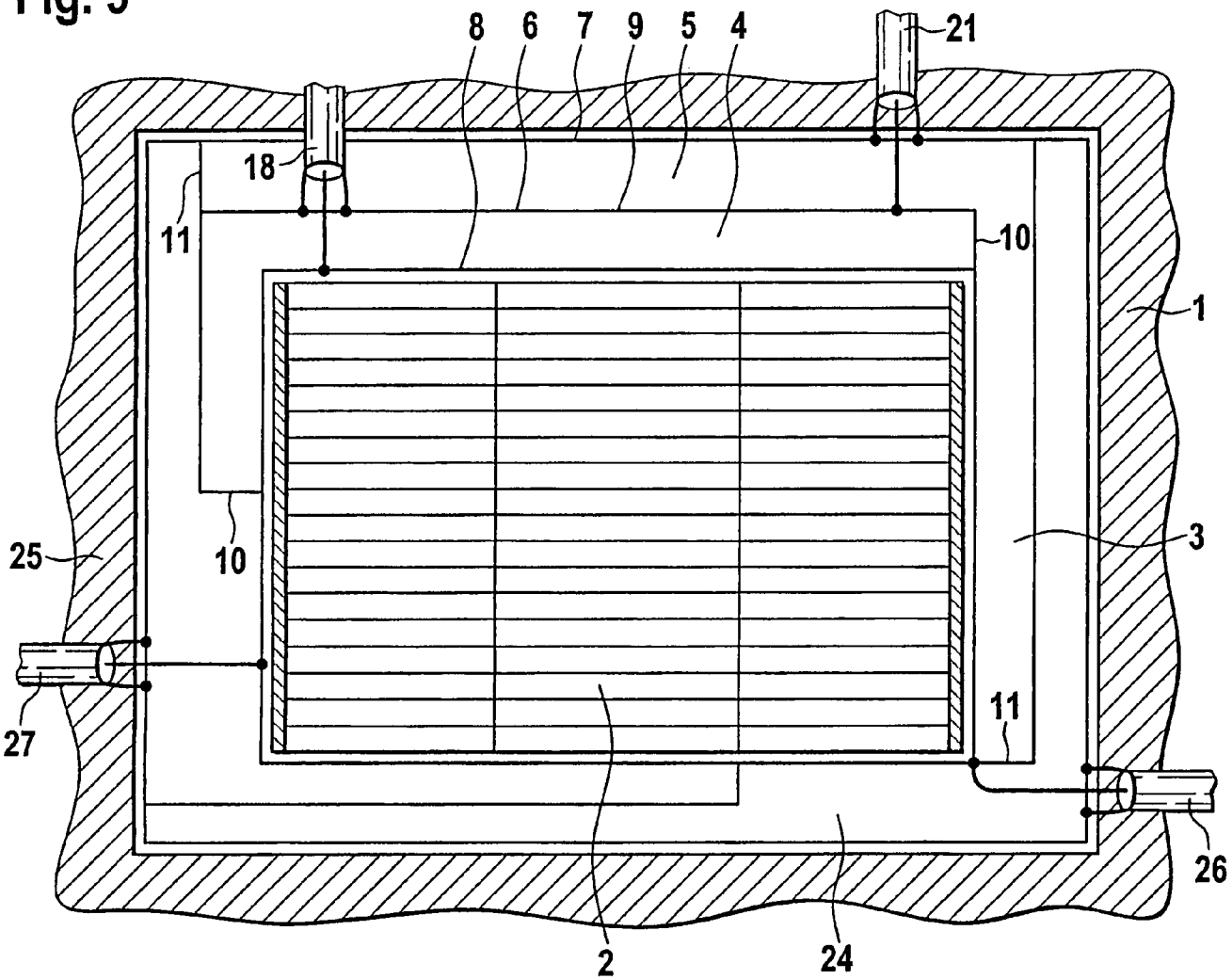
Figure 10:
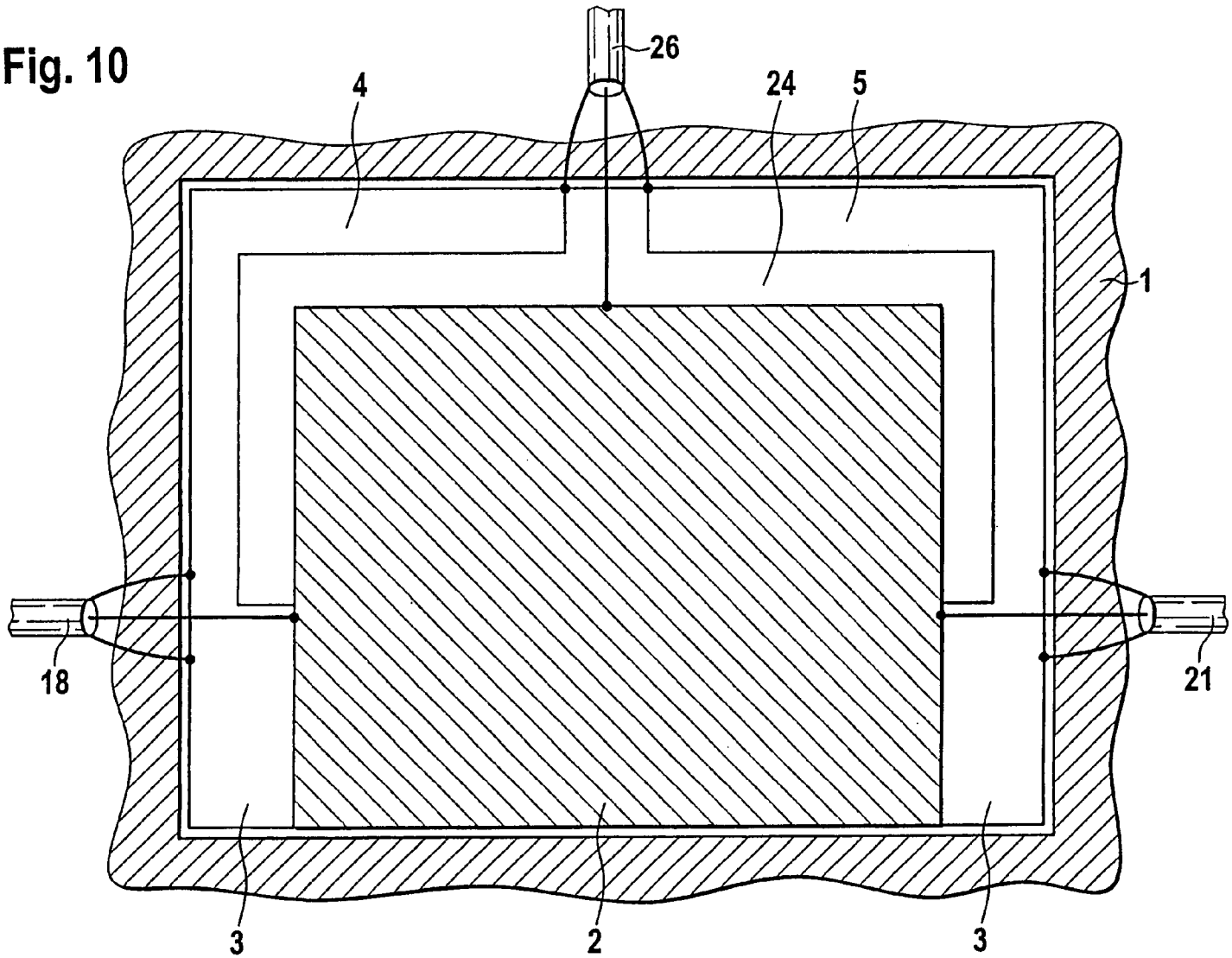
Figure 11:
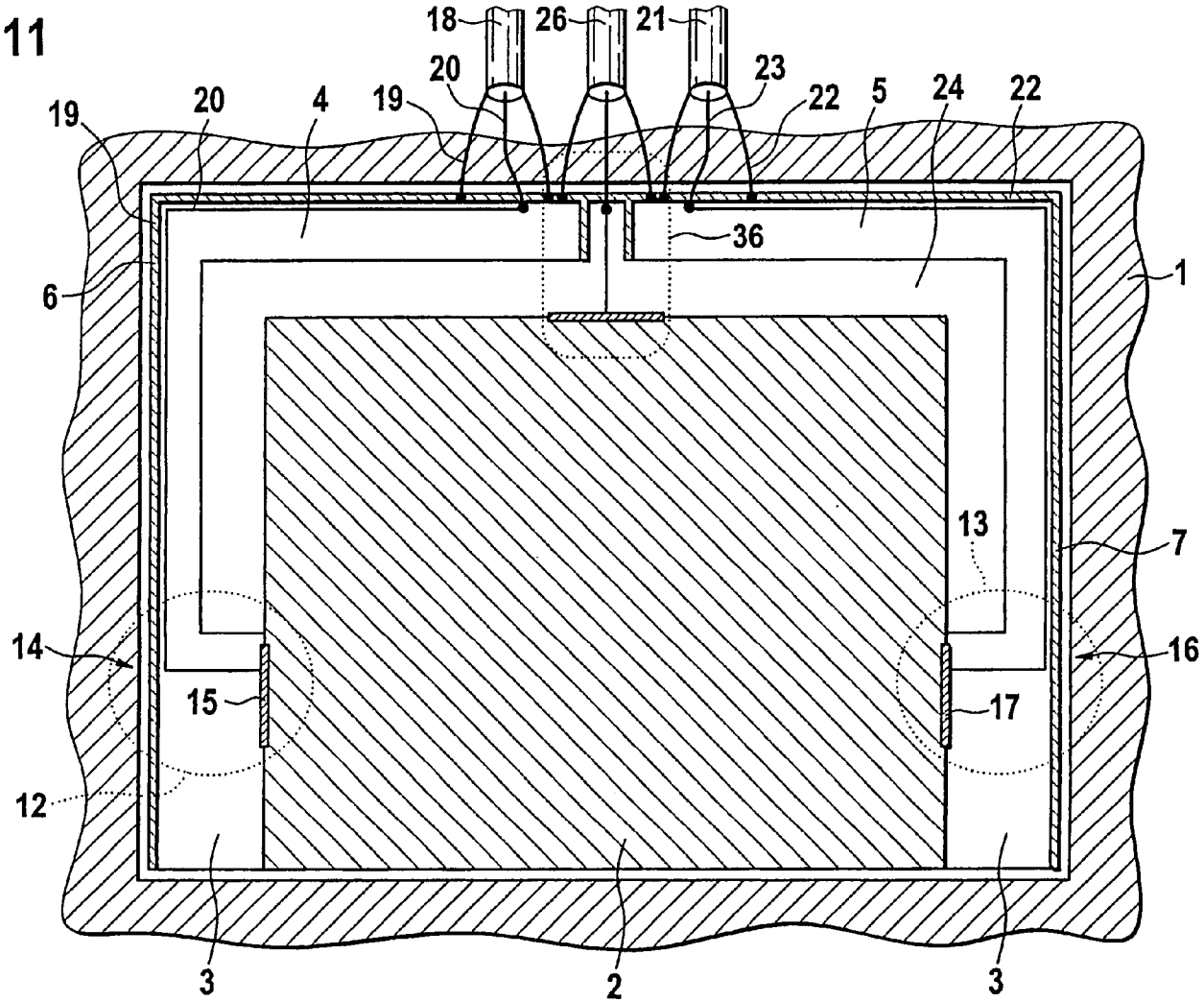
Figure 12:
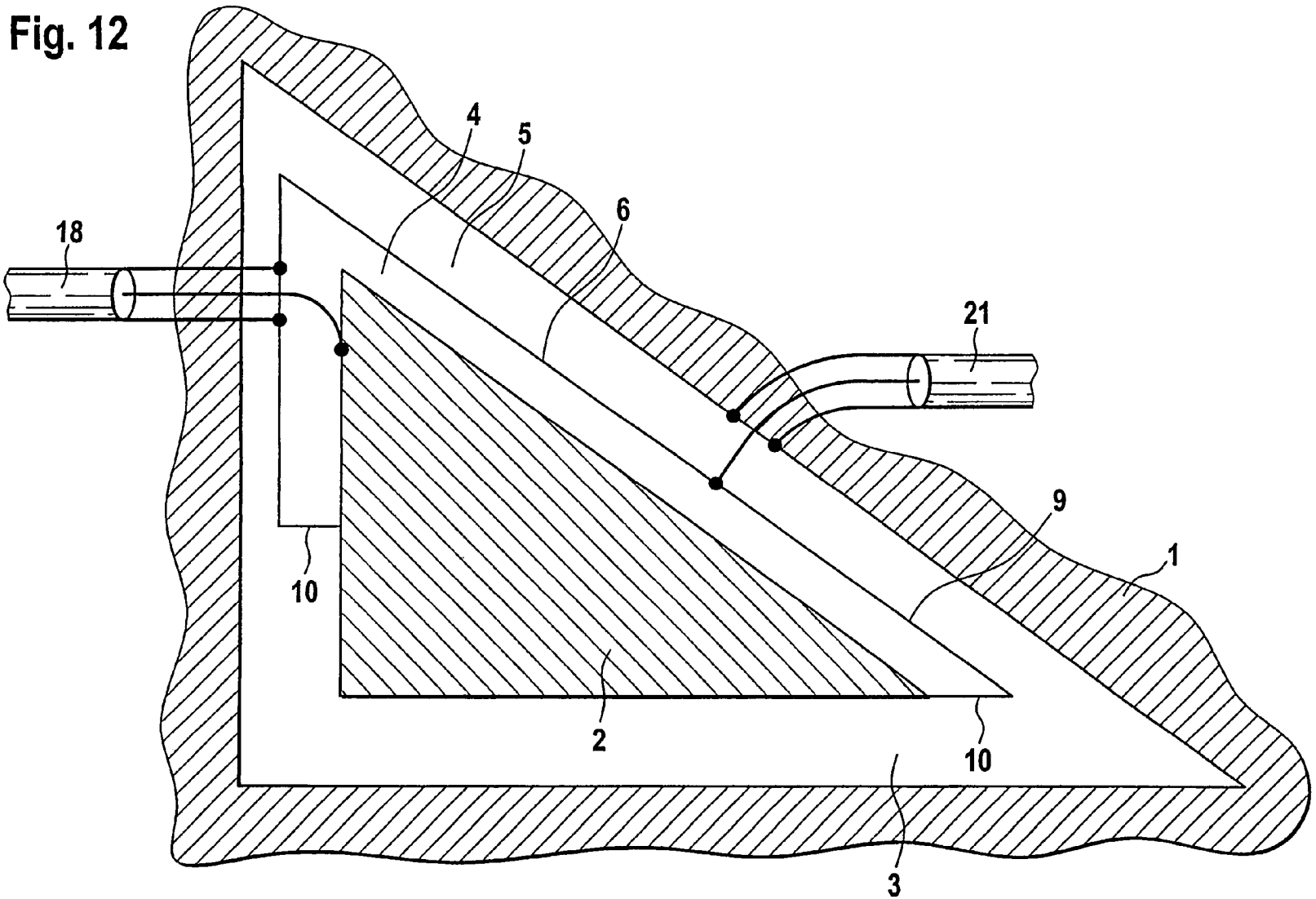
Figure 13:
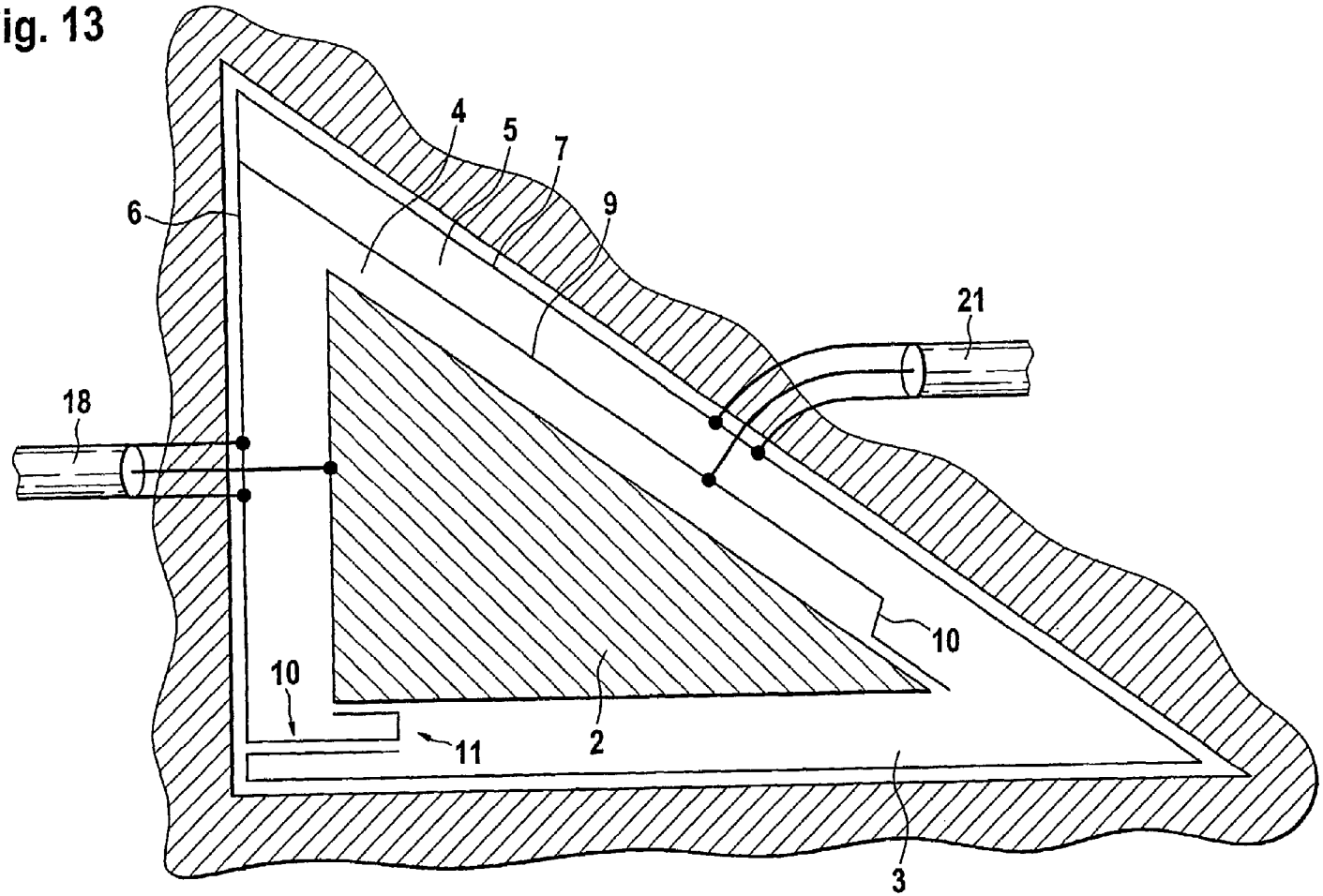

The invention is explained in greater detail in the following with the aid of schematic drawings. Shown are in:

FIG. 1 a first embodiment with two separate slot antennas,

FIG. 2 a second embodiment with two slot antennas immediately adjacent to each other and additional antennas for higher frequencies in the terminal areas of the slot antennas, FIG. 3 a third embodiment with a two-dimensionally extended metal structure arranged in one of the slot antennas, FIG. 4 a fourth embodiment similar to the third, but with laterally arranged terminal areas, FIG. 5 a fifth embodiment with capacitive break elements in the HF conductive frames of the slot antennas, FIG. 6 a sixth embodiment on which the slot antennas possess different geometric forms and run parallel and adjacent to one another over only part of their length, FIG. 7 a seventh embodiment with a slot antenna configuration adapted to a split heater grid, FIG. 8 an eighth embodiment on which an impedance transformer and/or antenna amplifier is provided in each terminal area of the slot antennas on the vehicle antenna pane, FIG. 9 a ninth embodiment with four slot antennas arranged around a heater grid, FIG. 10 a tenth embodiment with three slot antennas and a solar control coating extending to the bottom border of the pane as a conductive panel, FIG. 11 an eleventh embodiment as a variant of the tenth embodiment with adjacent connecting leads in the area of the upper centre section of the pane and pseudo-coaxial cable extensions on the vehicle antenna pane, FIG. 12 a twelfth embodiment with two slot antennas and a central conductive panel formed by a solar control coating on/in a vehicle antenna pane, FIG. 13 a thirteenth embodiment with two slot antennas and a conductive panel usable as an AM antenna and spaced from the metal surround on all sides.

All of the figures are schematic representations and must not be regarded as to scale. They serve to illustrate the principle behind the invention. The expert will, of course, for each specific requirement adapt the conductor structure to the actual geometry and dimensions of the pane and optimise the antenna arrangement in the usual way within the scope of the invention.

FIG. 1 shows a first embodiment of the invention. Identifiable is the metal surround 1 indicated by cross-hatchings, usually the metal vehicle bodywork, which has a polygonal opening, represented here as a rectangle for the sake of simplicity, in which a vehicle antenna pane is arranged. The pane itself is not shown. Rather, only the conductor structures essential for the antenna function are shown in the projection on the drawings plane (plane of the pane).

The vehicle antenna pane can be made in particular of single pane safety glass or multi-pane glass, particularly laminated safety glass. The conductor structures can be arranged entirely in a single plane or in different planes. Not shown are pane components not or not substantially contributing to the antenna function, such as laminating foils, non-conductive coatings such as opaque strips of baked-on enamel applied by the silk-screen method, with which the conductor structures are wholly or partly optically concealed, mounting adhesives, frame components (e.g. sealing profiles) and the like. Instead of the metal vehicle bodywork the metal surround 1 may also be formed by a grounded frame of flat or latticed conductors, for example, in the case of window openings in plastic bodywork or frameless or only partly framed window panes.

Shown at the centre of the pane is a heater grid consisting of a number of parallel horizontal heating conductors and two vertical bus bars at the borders which forms a conductive panel 2. To make it actually function as a panel being HF-conductive for all directions of wave polarisation, a sufficient number of vertical conductors running transverse the heating conductors and set at a suitable distance are provided for in the known manner. The arrangement of these conductors shown is purely schematic. It can be varied in many ways in the known manner, as long as the arrangement is such that the heater grid functions as a metallic (HF-conductive) panel for waves in the VHF range in all directions of polarisation. Within the scope of the invention, instead of a heater grid with crossing conductors, another conductor arrangement, for example, a conductive lattice or mesh structure or a conductive two-dimensionally extended layer can be provided for as the conductive panel 2. The heater grid may according to the needs be contacted either separately or commonly with one or more of the antennas of the inventive vehicle antenna pane.

The heating panel provided with the additional vertical conductors as conductive panel 2 and the metal surround 1 enclose a dielectric slot 3 in the form of a closed rectangular ring. To ensure that the slot antennas explained in greater detail in the following and their radiating areas 4, 5 function well, it is important that the conductive panel 2 is as extended as far as possible and the width of the slot 3 does not become too large. The conductive panel 2 is needed as a counter surface to the metal surround 1 for all slot antennas of the vehicle antenna pane according to the invention. This means that its distance from the individual slot antennas must not be too great. The same applies to the distance of the slot antennas from the metal surround 1. The width of the slot 3 should in particular be markedly less than a fifth of the mean wavelength (multiplied by the dielectric shortening factor of glass of about 0.6–0.7 of the relevant frequency range. It is within the scope of the invention if the conductive panel 2 is not spaced from the metal surround 1 all round, but in the area of one or more sides of the vehicle antenna pane extends up to the border of the pane, is thereby HF-coupled to the metal surround 1 and thus effectively terminates the slot 3. The invention accordingly also includes arrangements with a rectangular, L- or other shaped slot 3 where, however, the width of the slot 3 is always clearly less than its length.

In the upper half of the slot 3 are arranged two slot antennas which possess dielectric radiating areas 4, 5 surrounded (enclosed) by HF-conductive frames. The radiating areas 4, 5 of the two slot antennas are each shaped geometrically like an inverted U, where the radiating area 4 of one slot antenna is arranged inside the legs and base of the U of the radiating area 5 of the other slot antenna. The inner slot antenna incorporates a frame-like continuous structure of linear conductors, namely, a ground edge conductor 6 in the form of an inverted U running approximately through the centre of the slot 3, a signal edge conductor 8 in the form of an inverted U running adjacent to the heater grid, and two horizontal terminating conductors 10 running approximately through the vertical middle of the pane. The conductor structure of the outer slot antenna incorporates a ground edge conductor 7 in the shape of an inverted U arranged close to the metal surround 1, a signal edge conductor 9 in the shape of an inverted U running approximately through the centre of the slot 3 and two horizontal terminating conductors 11 which run approximately through the vertical middle of the pane and are aligned with the terminating conductors 10 of the inner slot antenna. The signal edge conductor 9 of the outer slot antenna and the ground edge conductor 6 of the inner slot antenna run parallel and adjacent to each other over their entire length in such a way that they are coupled to each another HF-conductively. By the expression "edge conductor" are meant those parts of the conductor which bound the radiating areas 4, 5 of the slot antennas along their longitudinal sides. The ground edge conductor 6, 7 is that edge conductor to which the ground conductor 19, 22 of the connecting lead 18, 21 described further down is connected. Correspondingly the signal edge conductor 8, 9 represents the edge conductor to be connected to the signal conductor 19, 22 of the connecting lead 18, 21.

The width of the radiating areas 4, 5 of the slot antennas is at any point never less than the minimum of approx. 1 cm required for faultfree function as a slot antenna in the VHF range. In the example shown the radiating areas 4, 5 of the two slot antennas are of approximately the same width. However, they could be of different widths, taking into consideration the above mentioned minimum width. At the top the width of the radiating areas 4, 5 is limited by the specified width of the slot 3. The width of the radiating areas 4, 5 of the slot antennas influences the band width of the receivable frequency range. As the width of the slot antenna increases, so does the band width.

The length of the radiating areas 4, 5 of the slot antennas is determined by the position of the terminating conductors 10, 11. These can be formed by conductors provided separately for this purpose, or the connecting conductors (not displayed here) of the heater grid can also act as terminating conductors 10, 11 for the slot antennas if they run across the slot close to the pane. For a good reception in the VHF range the length of the radiating areas 4, 5 of the slot antennas should in each case be close to half the mean wavelength (multiplied by the dielectric shortening factor of glass) of the relevant frequency range. The invention makes this possible by running two slot antennas parallel to each other over at least part of their length in such a way that even where space available for antenna purposes between the heater grid as conductive panel 2 with connections approximately in the vertical middle of the pane and the metal surround 1 is limited, two or more slot antennas of sufficient length and with a nevertheless adequately different directional characteristic can be constructed.

The individual conductors of which the HF-conductive frames of the slot antennas are made up can be mounted on/in the vehicle antenna pane in different ways. Thus, in the case of laminated glass panes, for example, wire-shaped or band-shaped metal conductors can be laid in the space between the panes. Normally, however, at least the major part of the conductors is formed from a printed and baked-on silk-screen-printed silver frit. The same applies to the other conductor structures of the vehicle antenna pane.

In the example shown the HF-conductive frames of the slot antennas are designed as continuous DC-conductive conductor structures. However, it is within the scope of the invention for the frame components not to be completely galvanically connected to one another but for at least one permanent or switchable DC-blocking or resistive break element which is conductive for the relevant frequencies in the VHF range to be provided for. Specifically by arranging individual conductor segments of the frame parallel a short distance apart their capacitive coupling can be ensured. Alternatively or supplementarily inductive coupling by coil-type conductor arrangements or provision for ohmic resistances is also feasible. Examples of HF-conductive break elements are explained below in the context of the appropriate drawings.

The inner slot antenna has a terminal area 12 near the left-hand end of the horizontal middle section of its radiating area 4, while the terminal area 13 of the outer slot antenna is arranged on the right-hand side of the horizontal middle section of its radiating area 5 and is thus at a relatively long distance from the terminal area 12. This spacing of the respective terminal areas 12, 13 imparts to the two slot antennas markedly different directional characteristics despite identical geometric form and adjacent position and makes them usable for diversity reception. In the terminal areas 12, 13 unbalanced connecting leads 18, 21 (coaxial cables) are connected galvanically to the conductor structures of the slot antennas. The signal conductor 20 (core) of the connecting lead 18 is connected to the signal edge conductor 8 and its ground conductor 19 (shielding) to the ground edge conductor 6 of the inner slot antenna, while the signal conductor 23 of the other connecting lead 21 is connected to the signal edge conductor 9 and its ground conductor 22 to the ground edge conductor 7 of the outer slot antenna.

In place of a galvanic connection of the connecting leads 18, 21 to the HF-conductive frames of the slot antennas a capacitive or inductive connection can also be provided for, as required, e.g. if the conductor structures to be connected are not arranged on an easily accessible outer pane surface or if a direct current flow is to be prevented.

To prevent the connecting lead 18 of the inner slot antenna arranged near the conductive panel 2 short-circuiting at HF and thus unintentionally shortening the outer slot antenna arranged near the metal surround 1, care must be taken that the connecting lead 18 is run across the radiating area 5 of the second slot antenna at a sufficient vertical distance. For slot antennas operating in the VHF range the vertical distance from the plane of the radiating area 5 should be not less than about one centimetre. This requirement must within the scope of the invention be generally observed for all conductors which are functionally not part of a slot antenna but run across this, if negative influences on the antenna function and an undesired effective length reduction of the slot antenna run across are to be avoided. In the figures the vertical distance between the connecting conductors is occasionally indicated by a curve in the run of the conductors.

Instead of coaxial cables other unbalanced connecting leads 18, 21 can also be used, e.g. pseudo-coaxial cables designed as flat cables.

FIG. 2 shows a vehicle antenna pane on which the geometric forms of the radiating areas 4, 5 of the slot antennas correspond to those of FIG. 1. By contrast with the embodiment shown there, however, on the variant shown in FIG. 2 the signal edge conductor 9 of one slot antenna is identical to the ground edge conductor 6 of the other slot antenna. Furthermore, in the terminal areas 12, 13 of both slot antennas additional antennas 30 are provided for which serve to receive higher-frequency waves, particularly in the gigahertz range, for example, for UHF reception, mobile phone, keyless vehicle access systems and the like. The additional antennas 30 can have many different kinds of conductor structures, so long as they do not effectively short-circuit the slot antennas or otherwise substantially impair their performance. In the example shown they are designed as wide-band mobile phone antennas incorporating in each case several monopoles 32 of different lengths and assigned virtual ground conductors (radials) 33, by analogy with multiband mobile phone antennas as known from EP 0 557 794 B1. The arrangement shown has the advantage that no additional connecting leads are required for connecting the additional antennas 30 but that the connecting leads 18, 21 of the two slot antennas can also be used for the additional antennas 30. The additional antennas 30 might alternatively be integrated into the connecting leads 18, 21 or arranged as separate elements on the antenna pane.

Likewise in the following diagrams, for the sake of simplicity, contiguous slot antennas are shown with common edge conductors, although this should not be regarded as restrictive. In all the embodiments described in the following slot antennas set at a distance from one another with separate edge conductors running one beside the other, as shown in FIG. 1, might also be used.

FIG. 3 shows a variant of the embodiment according to FIG. 2 in which provision is made inside the radiating area 5 of the outer slot antenna for a two-dimensionally extended metal structure 35—here shown only schematically—, which can incorporate, for example, a ground conductor arrangement for an external telephone antenna, a GPS receiving system, a signal light arrangement and the like. It is important that this metal structure 35 is arranged and the layout of the edge conductors 6, 9 of the radiating areas 4, 5 adapted such that the required minimum width of approx. 1 cm for the radiating areas 4, 5 of both slot antennas is kept throughout, as otherwise the effective slot length is undesirably reduced. The two-dimensionally extended metal structure 35 can, of course, also be extended three-dimensionally.

FIG. 4 shows a variant of the embodiment of FIG. 3 in which the metal structure 35 has a greater length and on which the terminal areas 12, 13 of the two slot antennas have been transferred to the area of the vertical side borders of the vehicle antenna pane. By contrast with the embodiments in the preceding figures, moreover, the terminal points 15, 17 have no galvanic connection to the respective signal edge conductors 8, 9, but instead are located on the monopole structures 32 of the additional antennas 30. The HF coupling to the signal edge conductors 8, 9 is done capacitively in each case through one of the monopoles 32 which is arranged in the immediate vicinity of the respective signal edge conductor 8, 9.

FIG. 5 shows a variant of the embodiment according to FIG. 4 in which the HF-conductive frames of the slot antennas possess capacitive break elements at several places marked by broken circles. This arrangement would also enable the separate signal edge conductor 8 of the slot antenna 4 to be dispensed with and the outer conductors of the heater grid to be used as signal edge conductors.

In the examples given hitherto the radiating areas 4, 5 of the two slot antennas in each case had the same geometric form, namely, that of an inverted U. FIG. 6 now shows a variant of the antenna arrangements presented hitherto in which the radiating areas 4, 5 of the slot antennas possess different geometric forms and run parallel and adjacent to one another for only part of their length, namely, in the area of the top centre area of the pane. The HF-conductive frames of the slot antennas each have in the example shown the form of an L lying on its side, where the first slot antenna is arranged with its radiating area 4 in the area of the upper right-hand corner and the second slot antenna with its radiating area 5 in the upper left-hand corner of the pane. The connecting lead 18 of the first slot antenna is connected far enough to the right to avoid traversing the radiating area 5 of the second slot antenna, so that an impairment of the function of this antenna can also be avoided even without the above explained vertical spacing of the connecting lead 18. Although in FIG. 6 and in some of the other figures the ground conductors 19, 22 are in each case shown doubled, this should be regarded as a non-restrictive schematic representation. Normally, of course, a single terminal point of a ground conductor 19, 22 to the respective ground edge conductor 1, 6, 7 suffices.

FIG. 7 shows a vehicle antenna pane having a split heater grid as the conductive panel 2. Both connectors of the heater grid (marked with "+" and "−") are, by contrast with the usual bilateral arrangement, located on only one side of the pane. Heater grids of this kind can be used, for example, with higher system voltages on vehicles or if for special reasons the current feed to the heating panel is to be supplied from one side only. Here, too, the two slot antennas run parallel over only part of their length. Again, the first slot antenna has an L-shaped radiating area 4. However, it extends further downwards than in the previous examples, an arrangement which is possible due to the absence of a heater grid connector on this side. The radiating area 5 of the second slot antenna has the shape of a U lying on its side. It extends from the upper border of the pane over the top half of the right-hand border of the pane to a point between the two parts of the heating panel and is terminated by the left-hand bus bar of the heater grid acting as terminating conductor 11. The great difference in the geometric form of the two radiating areas 4, 5 and the great distance between the terminal areas with the connecting leads 18, 21 makes the pane shown especially suitable for diversity applications.

The radiating areas 4, 5 of the two slot antennas of FIG. 8 again each have essentially the same geometric forms, namely, as in FIG. 1, that of an inverted U. By contrast with FIG. 1, however, the first slot antenna with its radiating area 4 is extended a little further downwards such that its terminating conductors 10 lie somewhat lower than the terminating conductors 11 of the second slot antenna. In the area above the heater grid are arranged two impedance transformers and/or antenna amplifiers (pre-amplifiers) 34, to which on the input side the slot antennas are connected via short connecting leads 18, 21 and from whose output side connecting leads 28, 29 in the form of coaxial cables run as the continuation of the connecting leads 18, 21 to the radio/TV receiver. Owing to the slight difference in the length of the radiating areas 4, 5 the arrangement shown is suited both for diversity applications and for multi-band reception. The arrangement of the impedance transformers and/or antenna amplifiers 34 immediately in the terminal areas of the slot antennas contributes to the improvement of the signal quality.

FIG. 9 shows a further embodiment of the invention with a total of four slot antennas each having L-shaped radiating areas 4, 5, 24, 25. The four slot antennas completely fill the slot 3 running round between the metal surround 1 and the conductive panel 2. In each case two of these run parallel for part of their length and are thus arranged pair-wise according to the invention. Each slot antenna has its own connecting lead 18, 21, 26, 27, which is connected to the respective conductor structures in accordance with the invention. The HF-conductive frames of all four slot antennas are designed as separate conductors arranged, in addition to the metal surround 1 and the conductive panel 2, on/in the vehicle antenna pane. They thus form a fourfold "slot-in-slot" structure, which because of the essentially identical length of the radiating areas 4, 5, 24, 26 and the differing geometric forms and position of the terminal areas are particularly suited for diversity applications within one VHF frequency range.

FIG. 10 shows a further embodiment, this time with an electrically conductive solar control coating as conductive panel 2, which extends as far as the bottom border of the pane in the vicinity of the metal surround 1 and thus encloses with the metal surround 1 a slot 3 shaped like an inverted U of finite length. Arranged in the slot 3 are three slot antennas with their connecting leads 18, 21, 26, where one of the slot antennas with its radiating area 24 in the shape of an inverted U is centrally located adjacent to the conductive panel 2, while the radiating areas 4, 5 of the two other laterally arranged slot antennas each have inverted L shapes pointing towards the horizontal middle of the pane. The connecting lead 26 of the centrally positioned inverted-U-shaped slot antenna with its radiating area 24 is arranged where the radiating areas 4, 5 of the two other slot antennas meet so as not to reduce their effective length.

FIG. 11 shows a variant on FIG. 10 in which to reduce the amount of wiring, all the connecting leads 18, 21, 26 of the three slot antennas are arranged one beside the other in the upper central area of the pane. The connecting leads 18, 21, 26, which are arranged in particular in a bunch or as a multiple lead, are each continued on the vehicle antenna pane as HF conductor in the form of a pseudo-coaxial cable. This enables the actual terminal areas 12, 13, 36 of the slot antennas to be transferred to a desired location, in particular from the upper centre of the pane to the left-hand and/or right-hand border of the pane. In the case of connecting leads 18 and 21 their signal conductors 20, 23 are continued on the pane and run for a little way parallel and adjacent to the ground edge conductor 6, 7 of the respective slot antenna, thus forming a pseudo-coaxial cable conductor structure. For this purpose the ground edge conductors are constructed over their entire length as largely widened conductors, e.g.—as shown—in strips or else as longitudinally extended mesh- or lattice-like structures. Roughly on a level with the bottom third of the pane the signal conductors 20, 23 are bent sharply towards the conductive panel 2 and terminate there in two-dimensionally extended terminal points 15, 17. The area comprising these terminal points 15, 17 and the points at which the signal conductors 20, 23 leave the ground edge conductors 6, 7 form the terminal areas 12, 13 of the slot antennas with their radiating areas 4, 5 in the shape of an inverted L. In this case the ground edge conductors 6, 7 up to the terminal areas 12, 13 function at the same time as a continuation of the ground conductors 19, 22 of the connecting leads 18, 21. Also in the case of the third slot antenna with its radiating area 24 in its terminal area 36 a pseudo-coaxial cable conductor structure is shown incorporating there the terminating conductors 10, 11, which are constructed wider than normal, and, arranged between them, the continuation of the signal conductor of the connecting lead 26. The two-dimensionally extended construction of the terminal points 15, 17 indicates that the connecting leads 18, 21 can also be capacitively coupled to the conductive panel 2 by arranging the terminal points 15, 17 and the conductive panel 2 one above the other in different planes of the pane.

Whereas the preceding embodiments would primarily be applicable for rear window panes or even vehicle windscreens, FIGS. 12 and 13 show applications of the invention on side windows (shown schematically in triangular form). Shown in each case is a conductive panel 2 located in the centre of the pane and separated from the metal surround 1 by a slot 3. In FIG. 12 a slot antenna with an angular radiating area 4 which is terminated by terminating conductors 10 is located adjacent to the conductive panel 2, while the other slot antenna has a polygonal (running right round/annular) radiating area 5 without terminating conductors. In FIG. 13 the radiating areas 4, 5 of both slot antennas have an angular form. The signal edge conductor 9 of the upper slot antenna is coupled capacitively but not galvanically to the conductive panel 2 by its bottom right-hand end. Also in the area of the terminating conductors 10, 11 in the area of the bottom left-hand corner of the pane the adjacent conductors are in each case coupled capacitively and/or inductively but not galvanically. This arrangement enables the conductive panel 2 also to be used as an AM antenna by means of the connecting lead 18, since the conductive panel 2 in the low-frequency range is decoupled from the metal surround 1 all the way round. The conductive panel 2 can, as in the preceding examples, be variously constructed, for example, as a conductive surface coating (solar control coating) or as a lattice-like conductor structure.

The variants, shown in the individual diagrams, of individual details of the vehicle antenna pane according to the invention can, without departing from the teaching of the invention, also be combined with one another in ways other than those shown. Not shown was the possibility of establishing a galvanic connection between one of the near-border ground edge conductors 6, 7 and the metal surround 1 in order to achieve better grounding. It is furthermore likewise within the scope of the invention also for other variants of the invention to construct the ground edge conductors arranged near the border as wide strips or as a striplike lattice structure or the like as shown in FIG. 11, to enable an improved capacitive coupling to the metal surround 1, particularly the vehicle bodywork.

Another option within the scope of the invention is to provide HF-transparent areas comprising island-like metallic areas (such as disclosed in the publications WO 96/31 918 A1, EP 0 531 734 B1, DE 195 08 042 A1, EP 0 717 459 A1) in the area of the dielectric slot 3 and notably in the radiating areas 4, 5, 24, 25 of the slot antennas. If desired the whole conductor arrangement needed may be manufactured by laser patterning, or by another post-treatment, of an essentially full-surface electrically conductive coating to create a pattern of non-conductive lines and HF-transparent areas which provides the HF-conductive frames and HF-transparent radiating areas of the slot antennas according to the invention.

"HF-transparent" denotes transparency for electromagnetic waves in the working frequency range of the antennas provided in the vehicle antenna pane. To achieve such HF-transparency the non-conductive lines of a line or grid pattern should according to experience be arranged at a distance of much less than a fifth of the relevant wavelength, preferably much less than one tenth of it. The pattern distances may be varied locally on one vehicle antenna pane. For example finer patterns may be provided in the vicinity of additional monopoles or dipoles for higher frequencies inside the radiating areas 4, 5, 24, 25 of the slot antennas than in areas without such additional antenna structures. Furthermore it is possible to provide line patterns only in one partial area and grid patterns in another partial area.

It is also possible to totally remove a conductive coating provided in the area of the dielectric slot 3 or to process its full surface rather than processing it only along lines, especially by masking certain areas before the deposition of the coating or by a mechanical, chemical or radiation post-treatment, to achieve the HF-transparency needed for the antenna function in the area of the dielectric slot 3 and notably in the radiating areas 4, 5, 24, 25 of the slot antennas.

One example of a vehicle antenna pane according to the invention constructed as described above comprises a pane provided with an electrically conductive coating, eg a solar control coating, on one surface of the pane which is extended practically to the pane edge. The additional conductor structures needed to provide the inventive slot antennas may be arranged on another surface of the pane. To make the invention applicable in this case the full-surface coating is made HF-transparent according to the publications mentioned above by patterning it locally with a grid of fine non-conductive lines at least in the area of the dielectric slot 3. Additionally the conductive coating may be divided in separate conductive macroscopic areas, notably to separate near-edge areas from a central area, for example the central conductive area functioning as the conductive panel 2 according to the invention, without making these near-edge areas HF-transparent by patterning them, provided however that these near-edge areas are not located in the area of the slot antennas.

While the individual elements making up the antennas may be provided on a single surface of the pane, it is evident that the invention is also applicable to vehicle antenna panes, wherein individual elements which provide the antenna function are arranged on different surfaces of the pane. For instance, the conductive panel 2 spaced from the metal surround 1 may be provided on a different surface from one or more of the additional antenna elements 6–11, 14–17, 30, 32–35 which constitute the HF-conductive frames of the slot antennas or their connectors or other components of the antenna arrangement. The foregoing graphical representation is in these cases to be understood as projection of the conductor structures or other antenna elements on a single plane.

Finally it needs to be emphasised that the invention is not restricted to the linear conductors featured in the drawings, for example as components of the HF-conductive frames of the slot antennas. It is rather within the scope of the invention to replace the linear edge conductors or antenna conductors with curved, wavy, fractal or other non-linear conductor arrangements or to use conductor areas or grid-like structures as long as the slot-in-slot principle described in the claims and in the forgoing description is not abandoned. In this way, additional advantages, including a higher bandwidth for the antennas, may be achieved.

The invention claimed is:

1. Vehicle antenna pane arranged in a metal surround and provided with a conductive panel spaced from the metal surround such that an elongated dielectric slot is produced between the two in which slot is arranged a number of slot antennas incorporating elongated radiating areas extending along the length of the slot the geometric forms of which are bounded by an HF-conductive frame incorporating at least one ground edge conductor and one signal edge conductor, and each of which radiating areas incorporate a terminal area in which at terminal points neighboured to one another the ground conductor of an unbalanced connecting lead assigned to the respective slot antenna is connected to the ground edge conductor and its signal conductor is connected to the signal edge conductor of the respective slot antenna, wherein at least two of said slot antennas are arranged parallel and adjacent to one another over at least a part of their length.

2. Vehicle antenna pane in accordance with claim 1, wherein the radiating areas of the slot antennas do not overlap in the projection on the plane of the pane.

3. Vehicle antenna pane in accordance with claim 2, wherein at least two of said slot antennas are arranged with their radiating areas in different planes of the pane.

4. Vehicle antenna pane in accordance with claim 3, wherein the terminal areas of the slot antennas are set at a distance from each other along the length of the slot.

5. Vehicle antenna pane in accordance with claim 1, wherein at least two of said slot antennas are arranged with their radiating areas in different planes of the pane.

6. Vehicle antenna pane in accordance with claim 1, wherein the terminal areas of the slot antennas are set at a distance from each other along the length of the slot.

7. Vehicle antenna pane in accordance with claim 1, wherein at least one of the radiating areas of the slot antennas has a geometric form differing from the geometric form of at least one of the other radiating areas.

8. Vehicle antenna pane in accordance with claim 1, wherein at least one of the radiating areas of the slot antennas has a length differing from the length of at least one of the other radiating areas.

9. Vehicle antenna pane in accordance with claim 1, wherein the HF-conductive frame of at least one of the slot antennas comprises at least one permanent or switchable capacitive, inductive or resistive break element.

10. Vehicle antenna pane in accordance claim 1, wherein at least one of the edge conductors of the slot antennas is arranged on/in the vehicle antenna pane as a separate ground edge conductor or signal edge conductor parallel and adjacent to the metal surround or the conductive panel.

11. Vehicle antenna pane in accordance with claim 10, wherein the separate ground edge conductor has a galvanic connection to the metal surround.

12. Vehicle antenna pane in accordance with claim 1, wherein the radiating areas of two slot antennas are arranged adjacent to each other in such a way that both slot antennas at least partly share a common edge conductor.

13. Vehicle antenna pane in accordance with claim 1, wherein an additional monopole or dipole antenna is arranged in the terminal area of at least one of the slot antennas are preferably inside its radiating area.

14. Vehicle antenna pane in accordance with claim 13 wherein the additional monopole or dipole antenna incorporates at least one monopole with at least one assigned virtual ground conductor and the virtual ground conductor is connected HF-conductively to the ground edge conductor of the slot antenna and the monopole is connected HF-conductively to its signal edge conductor.

15. Vehicle antenna pane in accordance with claim 1, wherein an impedance transformer and/or antenna amplifier is arranged in the terminal area of at least one of the slot antennas.

16. Vehicle antenna pane in accordance with claim 1, wherein at least one two-dimensionally extended metallic structure is provided for inside the radiating area of one of the slot antennas and at a sufficient distance from its signal edge conductors.

17. Vehicle antenna pane in accordance with claim 1, wherein at least one two-dimensionally extended metallic structure is provided for inside the slot but outside the radiating areas of the slot antennas and at a sufficient distance from their signal edge conductors.

18. Vehicle antenna pane in accordance with claim 1, wherein at least one of the connecting leads has an extension in the form of an HF conductor, in particular a pseudo-coaxial cable, arranged on/in the vehicle antenna pane.

19. Vehicle antenna pane in accordance with claim 18, wherein the ground conductor of the HF conductor is at least sectionwise identical to the ground edge conductor of one of the slot antennas and that the signal conductor of the HF conductor runs parallel and adjacent to the ground conductor of the HF conductor inside the radiating area of the slot antenna.

20. Vehicle antenna pane in accordance with claim 1, further comprising at least one terminating conductor terminating the slot antennas at their longitudinal ends.

21. Vehicle antenna pane for fitting within a metal surround, said pane comprising a conductive panel arranged to define an elongated dielectric slot between the metal surround and the conductive panel, at least two slot antennas each comprising a HF-conductive frame bounding elongated radiating areas which extend lengthwise along the slot, each slot antenna comprising opposed edge conductors adapted for the connection of connecting leads, at least two said slot antennas being arranged parallel and adjacent to one another over at least a part of their length.

* * * * *